US006805347B2

(12) United States Patent
Kuramoto

(10) Patent No.: US 6,805,347 B2
(45) Date of Patent: Oct. 19, 2004

(54) DESKEW MECHANISM AND METHOD

(75) Inventor: Akinobu Kuramoto, Pleasanton, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/298,883

(22) Filed: Nov. 18, 2002

(65) Prior Publication Data

US 2004/0094892 A1 May 20, 2004

(51) Int. Cl.[7] ..... B65H 9/04

(52) U.S. Cl. ..... 271/242; 271/243; 271/244; 271/245; 271/246; 83/934; 399/395; 493/340; 493/357

(58) Field of Search ..... 493/340, 352, 493/355, 356, 357; 83/934; 271/242, 243, 226, 244, 245, 246; 399/372, 395, 579; 400/579; 412/16; 270/52.17

(56) References Cited

U.S. PATENT DOCUMENTS 3,653,757 A * 4/1972 Newcomb ..... 399/387
3,884,103 A * 5/1975 Namba ..... 83/156
4,025,187 A * 5/1977 Taylor et al. ..... 399/394
4,891,681 A * 1/1990 Fiske et al. ..... 399/385
4,990,011 A 2/1991 Underwood et al.
5,171,006 A * 12/1992 Naito ..... 271/9.09
5,362,041 A * 11/1994 Ryuzaki et al. ..... 271/236
5,509,645 A * 4/1996 Shinno et al. ..... 270/58.17
5,565,970 A * 10/1996 Suda ..... 399/406
5,692,744 A * 12/1997 Funato ..... 271/242
5,904,350 A 5/1999 Creighton et al.
5,933,697 A * 8/1999 Onodera et al. ..... 399/406
6,099,225 A 8/2000 Allen et al.
6,361,036 B1 * 3/2002 Nakazawa ..... 270/58.07

FOREIGN PATENT DOCUMENTS

JP 57175643 A 10/1982

* cited by examiner

*Primary Examiner*—Patrick Mackey

(57) ABSTRACT

The skew of a sheet of print media is precisely controlled by intentionally inducing print media deformation, so that cooperative mechanical and gravitational forces may be used to align the leading edge of the sheet. The sheet is driven into a nip region of deskew rollers in a manner that causes the print media to deform, lifting a movable member in a direction substantially perpendicular to the feedpath into the nip region. The movable member applies a return force that is generally equal along a widthwise surface region of the print media. As a result, there is a reduced likelihood that the print media will be skewed relative to the nip region. In some applications, the return force is adjustable.

19 Claims, 8 Drawing Sheets

DESKEW MECHANISM AND METHOD

TECHNICAL FIELD

The invention relates generally to the field of media transport and more particularly to print media deskew methods and structural arrangements for use in print applications.

BACKGROUND ART

In many print media handling applications, it is desirable to minimize skew, where "skew" is defined as the misalignment of print media as a leading edge approaches or reaches a position in which print media orientation affects operations. For applications in which the print media is a sheet of paper or a transparency, the skew will often vary from sheet to sheet. Booklet making is one example of an application in which minimizing skew is an important consideration. U.S. Pat. No. 6,099,225 to Allen et al., which is assigned to the assignee of the present invention, describes what is referred to as a sheet-wise method of booklet making, since the finishing operations are performed on a sheet-by-sheet basis. The finishing operations include cutting, scoring, folding, punching, and stapling. Each sheet is cut to a length that is determined by its sequence in the booklet and by the thickness of the sheets that form the booklet. A sheet that is folded to provide the outer pages of a booklet may not be trimmed at all, while the sheet that is folded to provide the center pages of the booklet will be trimmed by the greatest amount. Because sheets are individually trimmed prior to final assembly, random misalignment of sheets would result in a ragged, unfinished appearance to the booklet. The random skew that is considered to be allowable will vary with the expectations of the manufacturer, but is often a maximum skew that is in the range of one sheet thickness (e.g., ±100 microns) to two sheet thicknesses (e.g., 200 microns).

Buckle deskew mechanisms are used in commercially available printers in which the acceptable skew is much greater. Such buckle deskew mechanisms are not capable of the accuracy required for booklet making. What is needed is a deskew mechanism that is suitable for use in applications in which cost is a significant concern, such as in desktop applications, and/or applications in which precise alignment is a significant concern, such as in sheet-wise booklet making.

SUMMARY OF THE INVENTION

The degree of skew of print media progressing along a feedpath to a nip region between deskew rollers is precisely controlled by intentionally introducing print media deformation, with the major directional component of the deformation being perpendicular to the plane defined by the feedpath immediately upstream from the nip region. In one embodiment, mechanical and gravitational forces cooperate to provide the skew control. The print media is driven into the nip region of the deskew rollers in a manner that causes the print media to deform, lifting a movable upper member in a direction substantially perpendicular to the feedpath. However, the upper member applies a return force that is generally equal along a widthwise surface region of the print media, thereby reducing the likelihood that the print media is skewed relative to the nip region.

DETAILED DESCRIPTION

Figure 1:
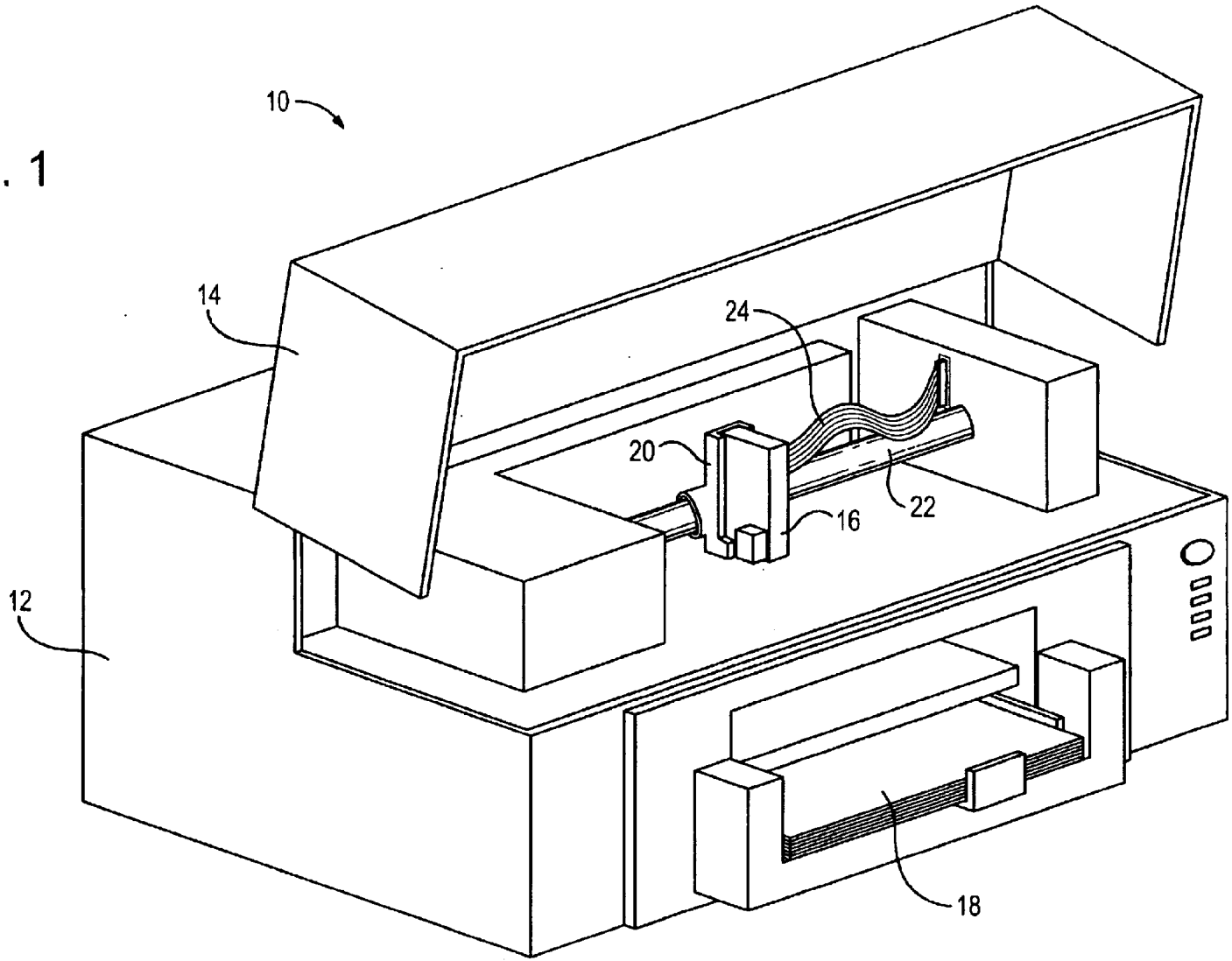
FIG. 1 is a perspective view of a printer, which is one example of a device that may use the deskew mechanism in accordance with the invention.

With reference to FIG. 1, a printer 10 is illustrated as merely one example of a device which may be adapted to include a deskew mechanism in accordance with the invention. Other devices may be similarly adapted. As used herein, "print media" refers to all types of paper, photographic paper, transparencies and other media used in devices such as printers and desktop publishing systems.

The printer 10 includes a body 12 and a hinged cover 14. Inkjet technology is employed, but this not critical to the invention. An inkjet printhead 16 is attached to a carriage 20 that moves back and forth along a carriage transport rail 22. A flexible cable 24 connects the components of the print carriage to a print engine, not shown. The flexible cable includes electrical power lines, clocking lines, control lines, and data lines. Nozzles of the inkjet printhead are individually triggered to project droplets of ink onto print media delivered from a media supply 18. During each print operation, the print media is stepped in one direction, while the inkjet printhead 16 is moved along the transport rail 22 in the perpendicular direction.

Figure 2:
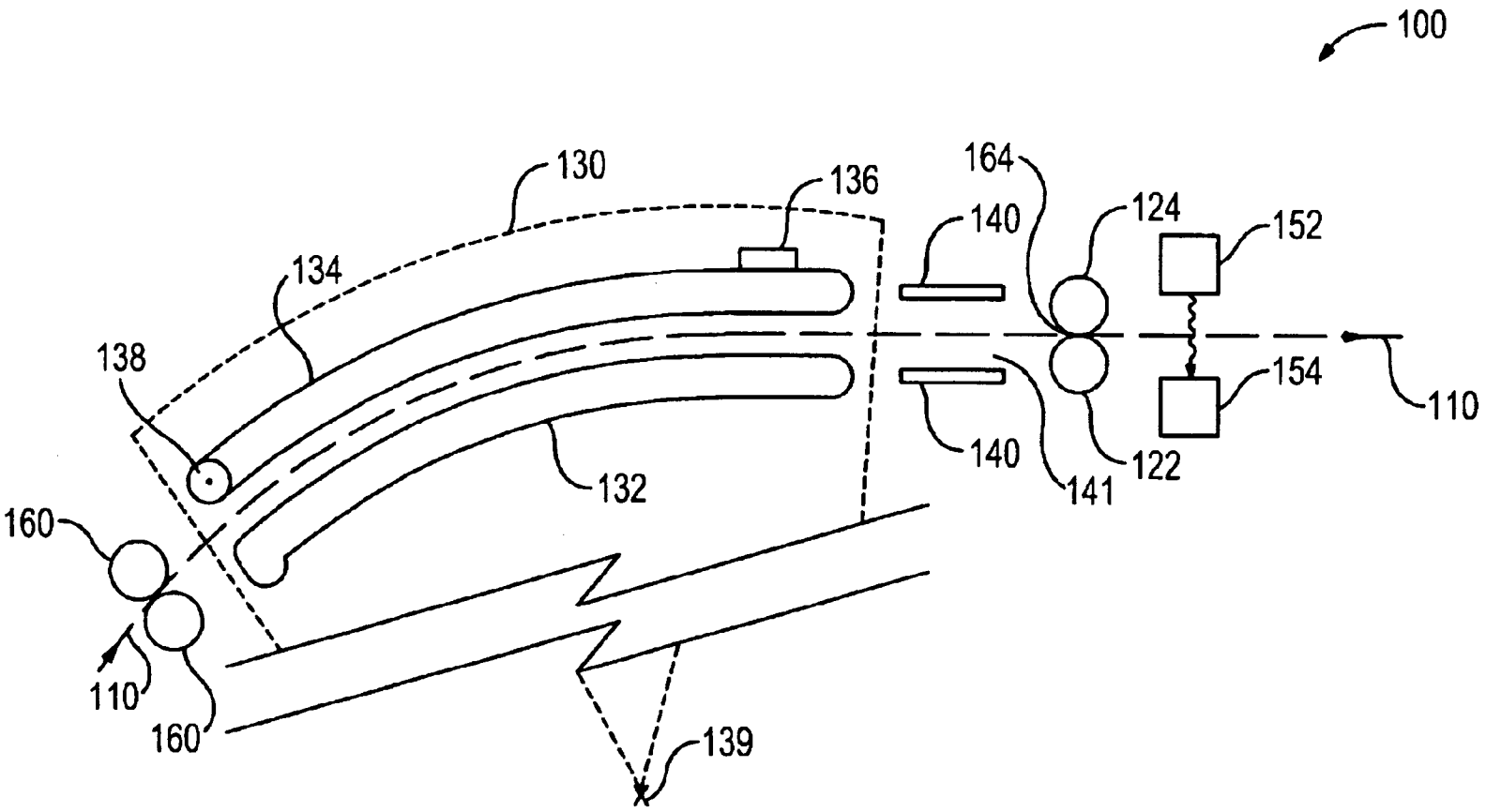
FIG. 2 is a diagrammatic cross-sectional view in the vertical plane of one embodiment of a deskew mechanism in accordance with the invention.

FIG. 2 illustrates an embodiment of a deskew mechanism 100 for use in the printer 10, as one example. The deskew mechanism includes a print media feedpath 110, a deskew drive roller 122, a deskew pinch roller 124, a guide structure 130, a fixed lower member 132, a movable upper member 134, a weight member 136, a hinge 138, a center of curvature 139, aperture plates 140, a fixed narrow aperture 141, a light source 152, a light detector 154, and feed rollers 160. In preparation for a print operation, print media is moved along the print media feedpath 110 through the deskew mechanism 100. While other embodiments are contemplated, the feedpath is substantially horizontal.

The print media is fed into the deskew mechanism 100 by the feed rollers 160. The length of the feedpath between the feed rollers and the deskew rollers 122 and 124 should be less than the length of a sheet of the print media. As a result, the print media will deform while traveling along the feedpath, if the rotations of the rollers are properly coordinated. The leading edge of the sheet of print media enters the deskew rollers before the trailing edge of the sheet leaves the feed rollers. While not shown in FIG. 1, the feed rollers are typically multiple rollers that are spaced across the width of the feedpath, but are driven by a single drive shaft. As is well known in the art, the deskew rollers 122 and 124 are similarly configured.

The deskew drive roller 122 (or the series of spaced apart deskew drive rollers on a single shaft) are made of a hard material in order to minimize slipping of the print media while the print media is moving through, or being held by, the deskew rollers 122 and 124. Typically, deskew drive rollers are formed of a compliant material. Hard rollers and grit rollers potentially provide increased advantages when used as the deskew drive roller or series of drive rollers. Grit rollers significantly reduce slippage. Grit rollers are known in the art for their use in pen plotters.

The guide structure 130 is located along the feedpath 110 between the feed rollers 160 and the deskew rollers 122 and 124. The guide structure includes the fixed lower member 132, the movable upper member 134, the weight member 136 and the hinge 138. The weight member 136 is positioned atop the movable upper member 134. The weight member may be adjustable in order to accommodate different types of print media. For example, the optimal gravitational force that is exerted on a deformed transparency may be significantly greater than the optimal gravitational force on a deformed piece of paper. The weight member may be manually replaced depending upon the type of print media or the adjustment may be automatically triggered by an optical or user-input identification of the media type.

As shown in FIG. 2, the axis of the hinge 138 is aligned perpendicular to the feed direction and is in a plane parallel to the feedpath. In the embodiment of FIG. 2, the fixed lower member 132 and the movable upper member 134 are curved and are conformal. The center of curvature 139 is represented below the fixed lower member 132. The advantages of the conformality and curvature will be described below, while referring to FIGS. 3 and 4. The movable upper member 134 may be a rigid structure. In FIG. 2, the movable upper member is a wire frame.

Aperture plates 140 are situated on the feedpath 110 between the guide structure 130 and the deskew rollers 122 and 124. The aperture plates are parallel to the feedpath, defining a fixed narrow aperture 141 for guiding the sheets of print media into the deskew rollers. The narrow aperture 141 is intended to restrict the print media deformation to an area spaced apart from the nip region 164 between the deskew rollers. In embodiments in which it is desired to measure the skew of print media, if any, or to detect the position of the leading and trailing edges of the sheets of print media, optical sensors are incorporated into the deskew mechanism 100. The light source 152 and the light detector 154 are positioned downstream of the feedpath 110 from the deskew rollers 122 and 124 for this purpose. As the print media passes between the light source and the detector, a light beam from the light source is interrupted, so that the edge of the sheet is detected. In some applications, two or more sensors may be required should it be desired to measure the skew of print media. The light source 152 may be a light emitting diode (LED) and the light detector 154 may be a photodiode. The components of the deskew mechanism 100 are attached to a rigid frame, such as the body 12 of the printer 10 of FIG. 1.

Figure 3:
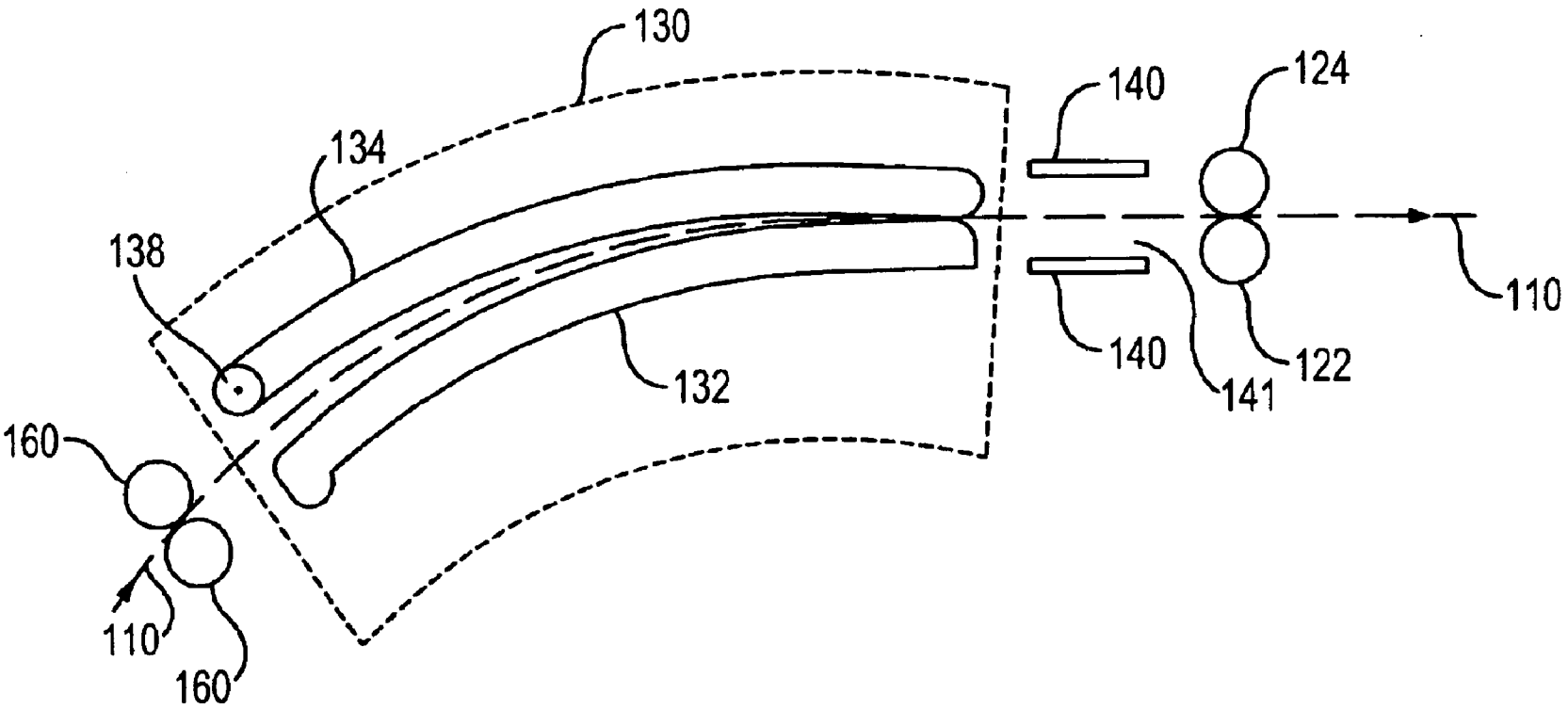
FIG. 3 is a side view of the deskew mechanism in a rest condition.
Figure 4:
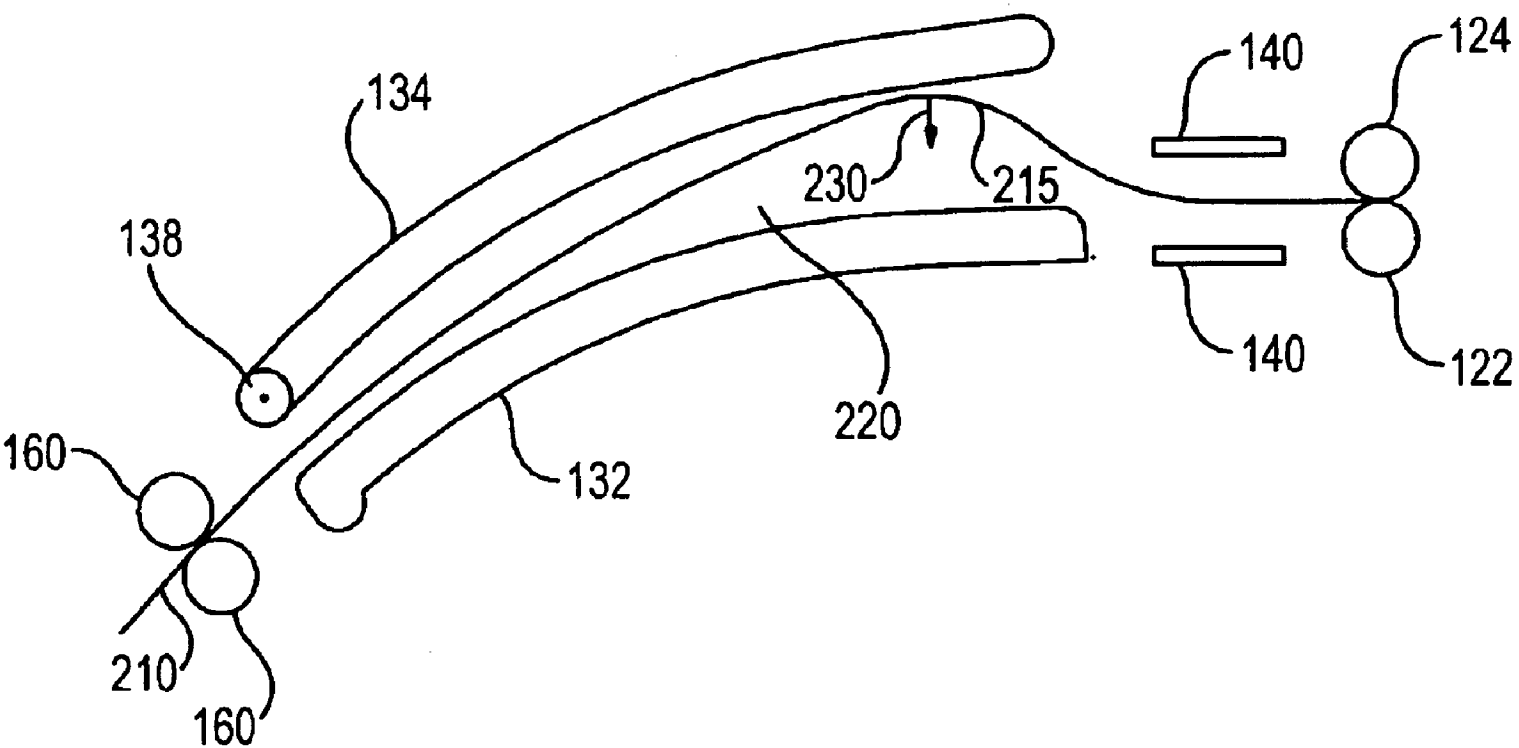
FIG. 4 is a side view of the deskew mechanism shown in a condition in which print media is being fed along a feedpath.

In FIG. 3, the guide structure 130 is shown in its rest condition in which there is no print media traveling along the feedpath 110. As a result, the movable upper member 134 rests on the fixed lower member 132 at the downstream end of the guide structure. On the other hand, FIG. 4 shows the guide structure in a media-feed condition. In this condition, the relative operations of the feed rollers 160 and the deskew rollers 122 and 124 induce a deformation of a sheet 210 of print media. For example, the deskew rollers may be stalled temporarily while the feed rollers progress the sheet 210 through the feedpath to the nip region of the deskew rollers. It should be noted that the feeding of the sheet results in a single buckle 215, which lifts the movable upper member 134. The movement of the upper member is about the axis of the hinge 138. Therefore, with the spacing between the lower and upper members 132 and 134 remaining generally constant and with the spacing between the aperture plates 140 remaining constant, the buckle 215 of the sheet 210 has a controlled position that is near the nip region without adversely affecting the entrance of the sheet into the nip region.

Arrow 230 in FIG. 4 represents the force that is applied to the sheet 210 at the buckle region 215. The gravitational force applied by the movable upper member 134 will result in a larger force driving the sheet into the nip of the deskew rollers 122 and 124, as compared to the force of the feed rollers 160 alone. Moreover, the force will be generally equal across the width of the sheet. In one embodiment, the sheets are driven into the nip region of the deskew rollers such that only a single buckle is formed in the sheet. In accordance with this embodiment, the guide aperture 220, which is formed by lifting the movable upper member 134, is kept relatively narrow. Moreover, the lower and upper members 132 and 134 can be substantially conformal, allowing for a narrow and uniform guide aperture. As can be seen in FIGS. 3 and 4, the upper and lower members are arcuate, so as to encourage the formation of a single buckle 215 in the sheet 210 of print media. In one embodiment, the arcuate members have relatively gentle curvature. The aperture plates 140 guide the sheet into the nip of the deskew rollers 122 and 124 without any further buckling.

Referring now to FIGS. 2, 3 and 4, the force applied by the movable upper member 134 on the buckle 215 in the sheet 210 of print media is determined by the mass of the movable upper member, the mass of the weight member 136, if used, and the spring constant if the hinge 138 is spring biased to the rest condition shown in FIG. 3. The deskew mechanism 100 can be optimized for the alignment of a particular type of print media by the choice of the mass of the weight member or the choice of the spring constant of the spring at the hinge. Thus, the mass of the weight member may be changed and the spring constant of the spring may be adjusted in order to accommodate different types of print media. The adjustments may be manual, but may be automatically imposed upon the selection of a print media during the selection of preferences for a particular print operation.

Figure 10:
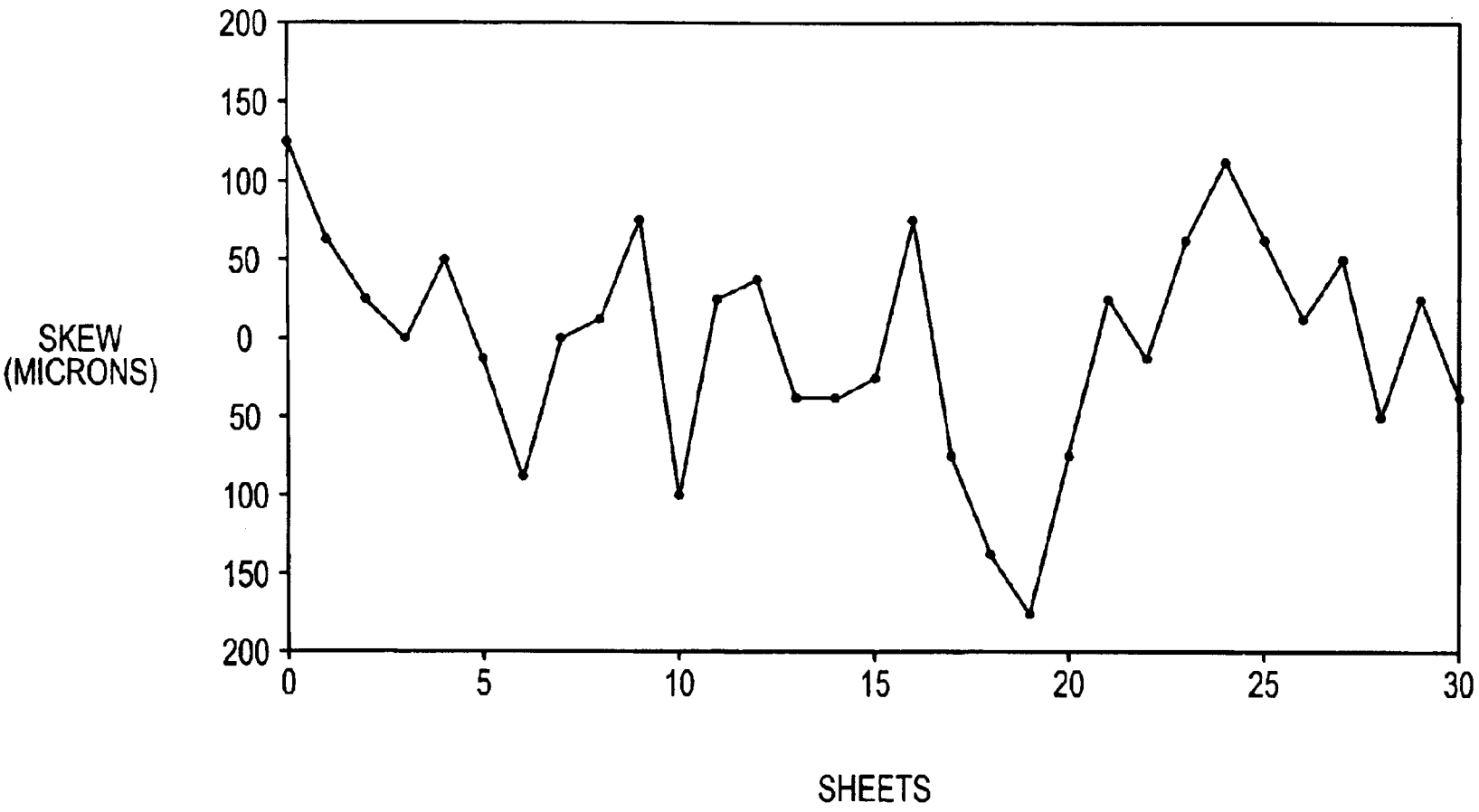
FIG. 10 shows a graph of the skew measured for paper sheets processed by the deskew mechanism of the present invention.

In the testing of a deskew mechanism 100 in accordance with the invention, the input of the mechanism was connected to a paper tray. Sheets of paper were aligned in the deskew mechanism and the skew was measured using optical sensors. The results for thirty sheets of paper are shown in FIG. 10. The mean skew was −0.8 microns (−0.03 mils) and the standard deviation was 70 microns (2.75 mils). This data shows that the deskew mechanism of the invention is capable of aligning a succession of sheets of print media to within a tolerance substantially less than ±100 microns (±4 mils), which is often used as the standard in booklet making.

Figure 5:
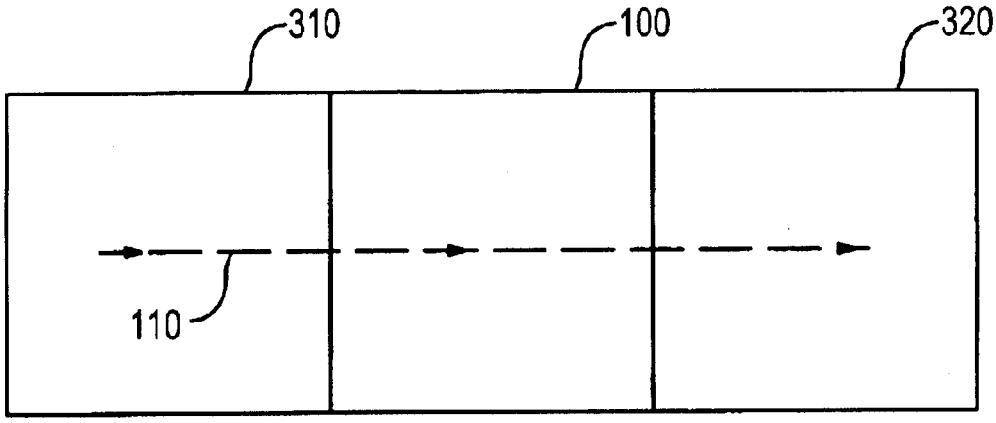
FIG. 5 is a side view of the coupling of a device which utilizes the deskew mechanism with other devices in which print media is manipulated.

FIG. 5 illustrates the integration of the deskew mechanism 100 with other stand-alone devices which utilize sheet feedpaths 110. The print media feedpath is shown as starting in a first device 310, passing through the deskew mechanism 100, where the sheets of print media are aligned, and finishing in a second device 320. Examples of the first and second print media devices include (1) a printer and a sheet-wise booklet finisher that individually trims sheets depending upon their position within a booklet, (2) a paper tray loaded with pre-printed print media and a sheet-wise booklet finisher, and (3) a paper tray and a full bleed printer. Examples (1) and (2) are different embodiments of sheet-wise booklet makers. In FIG. 4, the deskew mechanism is shown as including the feed rollers 160. However, in some applications it may be preferred to instead use the mechanism that is the sheet exit mechanism for the first print media device 310. In such applications, the first device 310 supplies the sheets to the guide structure of the deskew mechanism 100, so that the feed rollers 160 are no longer necessary within the deskew mechanism. Feed rollers, sheet exit mechanisms and any other mechanism that supplies the sheets to the guide structure of the deskew mechanism 100 are referred to as feed mechanisms.

Figure 6:
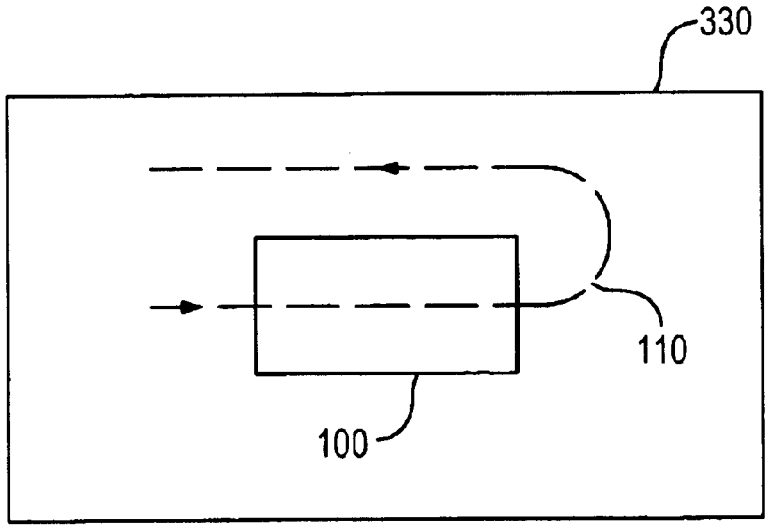
FIG. 6 is a block diagram of the integration of the deskew mechanism into a device in which print media is manipulated, such as in the printer of FIG. 1.

In FIG. 6, the deskew mechanism is shown as being incorporated into a print media device 330 having a feedpath 110. By incorporating the deskew mechanism into the print media device, the sheets of print media may be accurately aligned. Possible examples of the third media device include the printer 10 of FIG. 1, sheet-wise booklet finishers, and full bleed printers.

Figure 7:
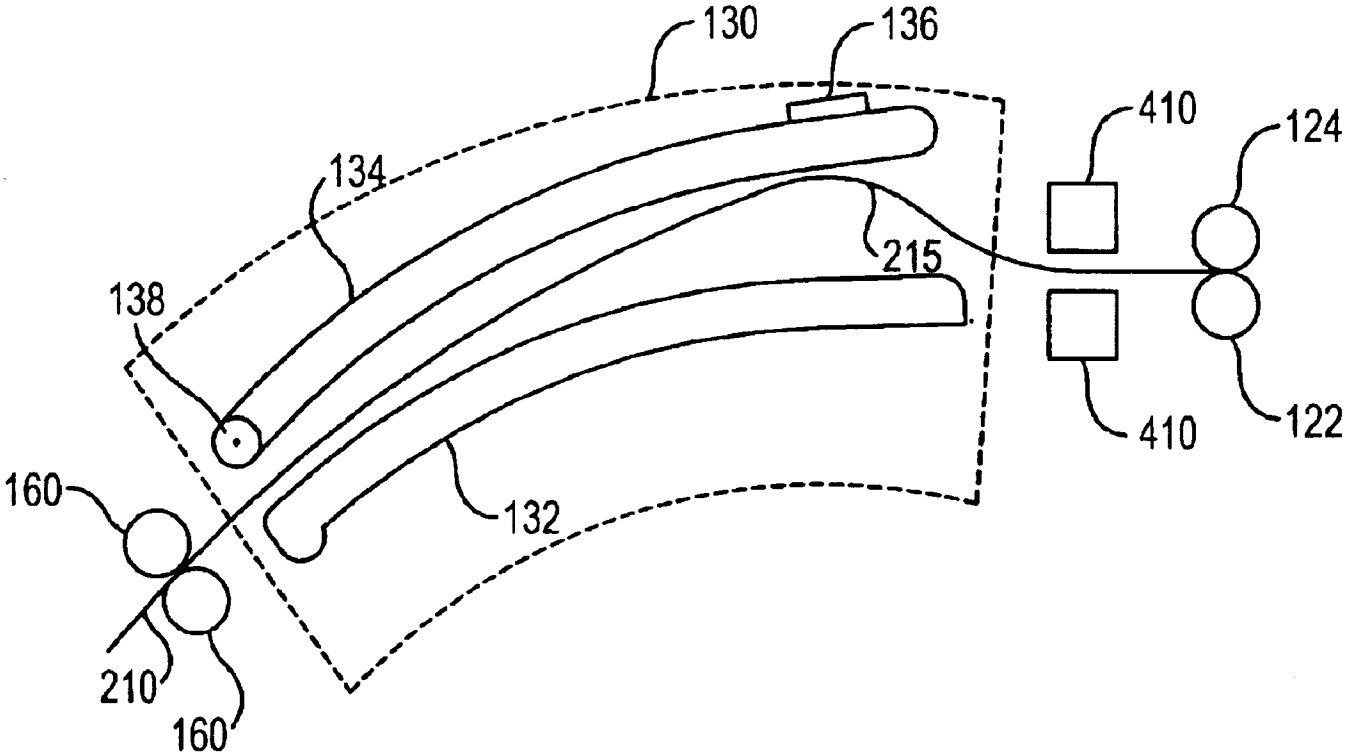
FIGS. 7, 8 and 9 illustrate the use of the deskew mechanism in the process steps of sheet-wise booklet finishing.
Figure 8:
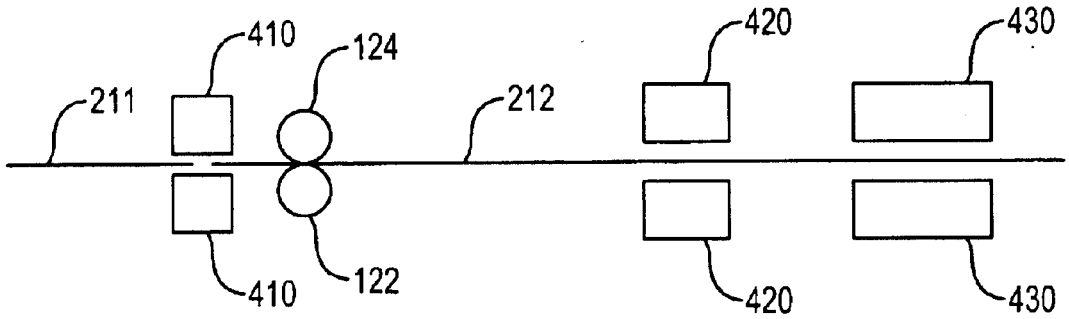
Figure 9:
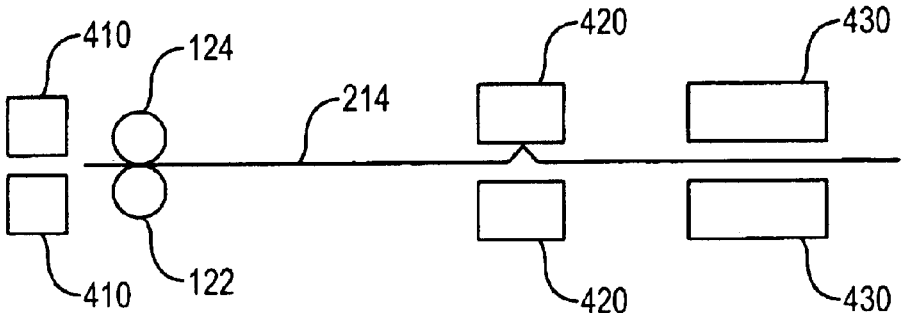

Perhaps the application with the lowest skew tolerance is sheet-wise booklet making, since finishing operations are often performed on a sheet-by-sheet basis. For booklets that are formed by folding each sheet at its center and stapling the folded sheets together, sheets at the center of the booklet should be shorter than those that are away from the center. Thus, the sheet trimming is carried out as a function of the size of the booklet, the thickness of the individual sheets, and the positions of the individual sheets within the booklet. The deskew mechanism of the present invention can be integrated with a sheet-wise booklet finishing apparatus to enable the aligning, trimming to length, scoring, and folding steps of the process, which are carried out on sheets of print media individually; the final step of stacking and stapling the sheets in a booklet. Shown in FIGS. 7, 8 and 9 are the deskew rollers 122 and 124, the guide structure 130, the fixed lower member 132, the movable upper member 134, the weight member 136, the hinge 138, the feed rollers 160, the print media sheet 210, a sheet trimming 211, a trimmed sheet 212, a folded sheet 214, the buckle 215, a trimming station 410, a scoring and folding station 420, and a stacking and stapling station 430. In FIG. 7, the deskew mechanism is used to align the sheet 210. The sheet is fed part way through the deskew rollers and then held in position while the trimming station 410 trims the trailing edge of the sheet, as represented in FIG. 8; the sheet trimming 211 is discarded. In FIG. 9, the trimmed sheet 212 of FIG. 8 is again held in position by the deskew rollers while the scoring and folding station 420 scores and folds the sheet. Finally, the folded sheet 214 is fed through the deskew rollers and progressed to the stacking and stapling station 430. In one embodiment, aperture plates for guiding the sheet of print media into the nip of the deskew rollers are integrated with the trimming station, which is not represented in the figures.

While the deskew mechanism in accordance with the invention has been described and illustrated as having upper and lower members, so that gravitational and mechanical forces cooperate to provide the deskew capability, there may be applications in which the invention uses spring force or other biases to localize the print media deformation directly adjacent to the entrance of the print media into the nip region. On the basis of the described deskew mechanism, the buckle is both proximate to and perpendicular to the nip region. However, aperture plates or similar structures may be used to ensure that the neighboring buckle is isolated from the ability of the deskew rollers to properly channel the leading edge of the print media.

Another possible modification to the deskew approach described with reference to FIGS. 3 and 4 relates to the technique for inducing the buckle 215 in the sheet 210. Rather than stalling the paper travel at the deskew rollers 122 and 124, the buckle may be induced by reverse driving. For example, the sheet of print media may be fed partially through the deskew rollers, whereafter stalling of the feed rollers 160 and reversal of the deskew rollers will cause the buckling to occur. The reversal of the deskew rollers should continue until the leading edge of the sheet resides within the nip of the deskew rollers. Subsequently, all operations will be identical to those that were previously described.

What is claimed is:

1. A sheet-wise booklet finisher located along a feedpath for print medium comprising:

deskew rollers positioned to provide a nip in which said print medium is received from an upstream side of said feedpath;

a fixed member adjacent to said deskew rollers at said upstream side of said feedpath;

a movable member that is cooperative with said fixed member to form a guide structure, said movable member having a rest condition in which said guide structure is configured to guide said print medium to said nip, said movable member having a displaced condition to accommodate deformation of said print medium at a location adjacent to said nip and in a direction in which the major directional component of displacement by said movable member is perpendicular to a path taken by said print medium in reaching said nip, said movable member being biased toward said rest position so as to apply a deskew force to said print medium when said deformation occurs;

a trimming station positioned between said guide structure and said deskew rollers, for individually trimming the trailing edges of sheets of said print medium;

a scoring and folding station positioned downstream on said feedpath from said deskew rollers, for individually scoring and folding said sheets; and a stacking and stapling station positioned downstream on said feedpath from said scoring and folding station, for stacking and stapling said sheets to make a booklet.

2. The booklet finisher of claim 1 wherein said movable member is biased toward said rest position by gravitational force, said movable member being an upper member of said guide structure, while said fixed member is positioned below said movable member.

3. The booklet finisher of claim 2 further comprising a weight member attached to said movable member, said weight member having a mass selected on a basis of biasing said movable member so as to align said print media along said nip.

4. The booklet finisher of claim 3 wherein said weight member is adjustable.

5. The booklet finisher of claim 1 wherein said guide structure is situated and configured to localize said deformation at a region neighboring said deskew rollers, said movable member being generally fixed at an upstream end and being free at a downstream end adjacent to said deskew rollers.

6. The booklet finisher of claim 5 wherein said upstream end of said movable member is attached to a hinge, said movable member being a rigid structure, said hinge having an axis that is perpendicular to a feed direction of said feedpath.

7. The booklet finisher of claim 6 further comprising spring coupled to said hinge for providing said bias of said movable member toward said rest position.

8. The booklet finisher of claim 1 wherein said fixed and movable members are arcuate and are substantially conformal when said movable member is in said rest condition.

9. The booklet finisher of claim 1 wherein said deskew rollers comprise a deskew drive roller and a deskew pinch roller, said deskew drive roller being formed of a hard material.

10. The booklet finisher of claim 1 wherein said deskew rollers comprise a deskew drive roller and a deskew pinch roller, said deskew drive roller being a grit roller.

11. The booklet finisher of claim 1 further comprising feed rollers situated upstream of said guide structure, where the length of said feedpath between said feed rollers and said deskew rollers is less than the length of a sheet of said print media.

12. A method of aligning a sheet of print media comprising:

progressing said sheet along a feedpath from a feed mechanism to deskew rollers;

driving said sheet into contact with said deskew rollers when said deskew rollers are stationary so as to induce sheet buckle that is local to said deskew rollers, including accommodating said sheet buckle such that said sheet buckle has a major directional component that is perpendicular to direct travel of said sheet into said deskew rollers, said sheet buckle being one in which a portion of said sheet adjacent to said deskew rollers is first diverted away from and then returned to a generally direct path to said deskew rollers, where said sheet buckle lifts a movable member of a guide structure leading to said deskew rollers;

utilizing the mass of said movable member to apply a gravitational force along said sheet buckle while said deskew rollers are stationary, said gravitational force thereby being local to said deskew rollers; and enabling selective adjustments of said gravitational force applied along said sheet buckle, so as to accommodate differences in properties of various types of print media which may be driven through said feedpath.

13. The method of claim 12 further comprising attaching said movable member to a hinge at an end of said movable member distal to said deskew rollers, said movable member being free to move at an end proximate to said deskew rollers so as to accommodate said sheet buckle adjacent to said deskew rollers and to apply said gravitational force to drive said sheet into a nip of said deskew rollers.

14. The method of claim 13 further comprising coupling a spring to said hinge so as to bias said movable member into a rest position in which a spacing between said movable member and an adjacent fixed member is generally constant for at least a major portion of said spacing, said spacing defining a region of said feedpath adjacent to said deskew rollers, said lifting of said movable member causing said spacing to increase significantly with approach to said nip.

15. The method of claim 12 wherein said deskew rollers comprise a deskew drive roller and a deskew pinch roller, said deskew drive roller being formed of a hard material.

16. A deskew mechanism for print media, the deskew mechanism being situated on a print media feedpath, the deskew mechanism comprising:

deskew rollers for aligning the print media;

aperture structure located at said deskew rollers to define a substantially straight path through which said print media travels immediately prior to reaching said deskew rollers;

a fixed lower member;

a movable upper member, said fixed lower member and said movable upper member forming a guide structure, said guide structure situated upstream in the feedpath from said deskew rollers, said movable upper member being substantially conformal to said fixed lower member, such that the print media, as it is driven into a nip of said deskew rollers, lifts said upper member in a direction substantially perpendicular to the feedpath, resulting in a guide aperture through which the print media passes, thus limiting the amount of buckle in the print media, said movable upper member applying a force on the print media in a direction substantially perpendicular to the feedpath, for driving the print media into said deskew rollers with greater force while said deskew rollers are stationary during a deskew operation;

a weight member attached to said movable upper member for applying gravitational force to the print media in a direction substantially perpendicular to said feedpath, wherein said weight member is variable such that said gravitational force applied to the print media by said weight member can be selected on a basis of a specific print media;

wherein said aperture structure and said guide structure are cooperative to induce said buckle to be localized to a region immediately prior to said aperture structure.

17. The deskew mechanism of claim 16 wherein said deskew rollers comprise a hard drive roller and a pinch roller.

18. The deskew mechanism of claim 17 wherein said hard drive roller is a grit roller.

19. The deskew mechanism of claim 16 wherein said aperture structure includes a pair of aperture plates aligned parallel to the feedpath and situated between said guide structure and said deskew rollers, forming a fixed narrow aperture on the feedpath for guiding the print media into said deskew rollers without further buckling.

* * * * *